US011933043B2

(12) United States Patent
Van Den Broek et al.

(10) Patent No.: US 11,933,043 B2
(45) Date of Patent: Mar. 19, 2024

(54) MODULAR WALL SYSTEM

(71) Applicant: Stabilo Management B.V., Eindhoven (NL)

(72) Inventors: Christiaan Van Den Broek, Eindhoven (NL); Henri Van Der Hoorn, Eindhoven (NL)

(73) Assignee: Stabilo Management B.V., Eindhoven (NL)

( * ) Notice: Subject to any disclaimer, the term of this patent is extended or adjusted under 35 U.S.C. 154(b) by 0 days.

(21) Appl. No.: 17/747,132

(22) Filed: May 18, 2022

(65) Prior Publication Data

US 2022/0372750 A1 Nov. 24, 2022

(30) Foreign Application Priority Data

May 18, 2021 (NL) ..... 2028235

(51) Int. Cl.
*E04B 2/74* (2006.01)
*E04B 2/76* (2006.01)

(52) U.S. Cl.
CPC ..... *E04B 2/7405* (2013.01); *E04B 2/762* (2013.01)

(58) Field of Classification Search
CPC ..... E04B 2002/7479; E04B 2002/7466; E04B 2002/747; E04B 2002/7475; E04B 2/762;
(Continued)

(56) References Cited

U.S. PATENT DOCUMENTS 4,112,643 A * 9/1978 Decker ..... B44C 7/022 160/395
4,158,936 A * 6/1979 Fulton ..... E04B 2/7425 52/794.1

(Continued)

FOREIGN PATENT DOCUMENTS

DE 202018103900 U1 * 10/2018
DE 202018103900 U1 10/2018

(Continued)

OTHER PUBLICATIONS

International Searching Authority at European Patent Office; Report concerning novelty search of international type for Netherlands Application No. 2028235, report dated Feb. 7, 2022 (includes English translation).

*Primary Examiner* — Theodore V Adamos
(74) *Attorney, Agent, or Firm* — McDonnell Boehnen Hulbert & Berghoff LLP

(57) ABSTRACT

The invention relates to a modular wall system comprising a number of mutually releasably couplable wall modules for forming in coupled state a reusable assembled wall, wherein a wall module comprises a wall part with attaching means for releasably attaching at least an exchangeable cloth along at least one side of the wall part, wherein the attaching means comprise:

- at least a first cloth attaching element arranged close to or on a first outer end of the wall part;
- at least a second cloth attaching element arranged close to or on a second, opposite outer end of the wall part;
- an exchangeable cloth to be attached along the at least one side of the wall part to the first and second attaching element mounted on the wall part for the purpose of providing a desired appearance on the relevant side of the wall part.

20 Claims, 15 Drawing Sheets

(58) Field of Classification Search
CPC . E04B 2/7405; E04B 9/303; E04B 2009/0492
See application file for complete search history.

(56) References Cited

U.S. PATENT DOCUMENTS

| | | | | | |
|---|---|---|---|---|---|
| 4,391,073 | A * | 7/1983 | Mollenkopf | G10K 11/16 | 52/145 |
| 4,457,117 | A * | 7/1984 | Leiher | E04B 2/7416 | 403/44 |
| 4,891,922 | A * | 1/1990 | Hozer | E04B 2/7422 | 52/239 |
| 4,949,518 | A * | 8/1990 | Nagel | E04B 2/7416 | 52/316 |
| 5,689,924 | A * | 11/1997 | Mason | E04B 2/7416 | 52/273 |
| 5,737,893 | A * | 4/1998 | Rossiter | E04B 2/7425 | 160/381 |
| 5,875,596 | A * | 3/1999 | Muller | E04B 2/7433 | 52/239 |
| 6,141,926 | A * | 11/2000 | Rossiter | E04B 2/7425 | 52/239 |
| 7,712,268 | B1 * | 5/2010 | Guthrie | E06B 5/003 | 52/202 |
| 2006/0080919 | A1 | 4/2006 | Dykstra et al. | | |
| 2010/0083601 | A1 * | 4/2010 | Glazik | E04B 2/7453 | 52/481.1 |
| 2010/0116445 | A1 * | 5/2010 | Morris | E04B 9/303 | 160/327 |

FOREIGN PATENT DOCUMENTS

| | | | | |
|---|---|---|---|---|
| FR | 2843140 | A1 * | 2/2004 | B44D 3/185 |
| WO | WO-2022043174 | A1 * | 3/2022 | B44D 3/185 |

* cited by examiner

MODULAR WALL SYSTEM

REFERENCE TO RELATED APPLICATION

This application claims priority benefits under 35 U.S.C. § 119 to Netherlands Patent Application No. NL 2028235, filed May 18, 2021. Netherlands Patent Application No. NL 2028235 is hereby incorporated by reference.

BACKGROUND

The invention relates to a modular wall system comprising a number of mutually releasably couplable wall modules for forming in coupled state a reusable assembled wall. The invention also relates to the erecting (and dismantling) of such a modular wall system.

Freestanding walls are often used at trade shows and exhibitions for dividing large spaces into smaller spaces. These walls are usually temporary and can either be custom-made, which is expensive and labour-intensive, or be assembled from wall systems which are modular or in any case consists of prefabricated standard components. Depending on the situation, constructing walls using a modular wall system has the advantage that the construction requires less work, that a more consistent quality can be delivered and/or that a large part of the wall system is reusable.

Existing modular wall systems have the drawback that the walls constructed therewith consist of panels of plate material, wherein connecting points between the different plates remain visible on a placed wall. This is a problem mainly in situations where it is desired to achieve a high-quality visual finish of sub-spaces, such as for instance at locations where art is displayed or where luxury goods are shown. Attempts to mitigate this drawback by providing the walls with for example fabric have proven only partly successful because it has been found very difficult in practice to apply such a visual finish correctly and evenly.

In a determined type of modular wall system a cloth is arranged in front of the visible side of a wall, for instance by stapling the cloth to the wall on the upper side of the wall and on the underside using a large number of staples. This known type of modular wall system however also has a number of drawbacks. Firstly, it is labour-intensive to manually attach the cloth with staples in situ (i.e. at the location where the wall has been temporarily erected). Moreover—and this is sometimes even more significant in practice—it requires a lot of skill to attach the cloth smoothly (without folds, unevenness and the like) in this way. In practice, it takes years for someone to build up enough skill to attach such a cloth to the walls with a sufficient degree of perfection and at a sufficiently high speed. A further drawback is that, after erecting and dismantling such a wall, there is rather a lot of residual material, such as staples, that must be removed from the wall and should be considered waste thereafter (and is therefore not reusable). In the existing modular wall system the cloth extends directly in front of or against the wall surface, which has the drawback that parts of the wall protruding from the wall surface remain visible in the cloth. This is detrimental to the appearance of the wall system.

OVERVIEW

The object is to provide a modular wall system and a method for erecting and/or dismantling such a modular wall system, wherein at least one of said drawbacks and/or other prior art drawbacks are at least partially obviated.

According to a first aspect a modular wall system of the type stated in the preamble is provided, wherein a wall module comprises:

- a wall part with attaching means for releasably attaching at least an exchangeable cloth along at least one side of the wall part, wherein the attaching means comprise at least a first cloth attaching element arranged close to or on a first outer end of the wall part and/or at least a second cloth attaching element arranged close to or on a second, opposite outer end of the wall part;
- an exchangeable cloth to be arranged in front of the at least one side of the wall part for the purpose of providing a desired appearance on the relevant side of the wall part, wherein the cloth is configured to be attached to at least one of the first and second cloth attaching element.

Using said first and second cloth attaching elements at both outer ends of the wall part enables the cloth to be attached to this wall part in simplified manner and also to be removed therefrom again in simple manner. Because it is simpler to attach the cloth, the cloth can be arranged by less experienced persons and/or a more constant appearance of the wall can be realized.

In determined embodiments of the invention at least one of the first and second cloth attaching element is embodied for hooking the cloth thereto. The cloth attaching element is for instance provided with a number of protrusions such as pins or teeth in which the cloth can secure itself. A cloth attaching element can for instance comprise a row of teeth which are suitable for pinning the cloth therewith. In these embodiments the cloth need then for instance only be folded round the attaching element in order to be attached to the wall part, while the cloth can be released from the wall part by pulling the secured or hooked cloth loose from the protrusions again.

The cloth can be secured to one of the attaching elements, although the cloth is preferably secured to both the second (for instance upper) attaching element and the first (for instance lower) attaching element.

In determined embodiments of the invention the first and second cloth attaching element extend substantially parallel to each other so that the cloth can easily be arranged tautly in front of the wall. The cloth attaching elements are preferably further configured to tension the cloth between the cloth attaching elements at a distance in front of said side of the wall part. The attaching means are more particularly configured to tension the cloth tautly at a distance in front of said side such that the cloth conceals said side of the wall part from view without touching the side of the wall part. A sufficiently great distance is opted for to ensure for instance that any protrusions of the wall do not become visible in the cloth. This distance characteristically amounts to at least 0.5 cm, preferably at least 1 cm.

The first and second cloth attaching element can be arranged such that they extend along respectively upper edge and lower edge of the wall part. In further embodiments in which each attaching element comprises a row of teeth, the row of teeth extends substantially parallel to the first or second outer end of the wall part and/or over essentially the whole width of the wall part. The cloth can hereby be arranged over the whole visible side of the wall part. In determined embodiments the teeth extend obliquely inward relative to said side of the wall part in the first and/or second cloth attaching element. When a force is exerted on the cloth, for instance a force attempting to displace the cloth upward or downward, the cloth is pressed into the teeth still further by the oblique position of the teeth and the risk of the cloth coming loose is reduced. In determined embodiments the angle ($\alpha$) between the teeth and said side of the wall part has a value of between 30 and 60 degrees. It has been found that the cloth can be secured properly and with little effort at such an angle.

In determined embodiments the attaching elements are arranged on only one side of the wall part. In other embodiments both sides of the wall part (front side and rear side) and optionally also the sides are provided with attaching elements. The cloth can then be attached on any side (front side, rear side or on both the front and rear side, one or more of the sides).

The modular wall system can comprise a first mounting profile arranged on the first outer end of a wall part of a wall module. At least one first attaching element can then be arranged on this profile (wherein the attaching elements are for instance formed from separate components), which can be mounted on mounting profiles or are formed integrally therewith. The mounting profile further comprises a receiving space for receiving therein a first coupling element whereby wall parts of adjacent wall modules can be coupled to each other. The first (lower) profile is preferably provided on the lower side of the relevant wall part. The receiving space is for instance situated on the underside of the mounting profile so that the wall part comes to rest on the first (lower) coupling element. The coupling element can for instance be formed by a coupling beam or coupling slat slidable in the receiving space. This can for instance be manufactured from wood, but plastic coupling elements can also be applied. The coupling element preferably has a flat underside in order to enable the first coupling element and the wall part arranged thereon to be positioned on a flat ground surface in stable manner.

In similar manner the modular wall system comprises a second mounting profile which is arranged on the second outer end of a wall part of a wall module and having at least one second attaching element arranged thereon or formed integrally therewith. In determined embodiments the second mounting profile likewise comprises a receiving space for receiving therein a second coupling element whereby wall parts of adjacent wall modules can be coupled to each other. In embodiments with both a first and second mounting profile the wall parts can for instance be couplable to each other on both their upper ends and their lower ends.

Another aspect relates to a modular wall system comprising a number of wall modules which are releasably couplable to each other for the purpose of forming in coupled state a reusable assembled wall. This wall module comprises:

- a wall part;
- a first mounting profile arranged on a first outer end of a wall part of the wall module, wherein the first mounting profile comprises a receiving space for receiving therein a first coupling element whereby wall parts of adjacent wall modules can be coupled to each other.
- a second mounting profile arranged on a second outer end of the wall part of the wall module lying opposite the first outer end, wherein the second mounting profile comprises a receiving space for receiving therein a second coupling element whereby wall parts of adjacent wall modules can be coupled to each other.

In determined embodiments the attaching elements in the first and second mounting profiles are formed such that they protrude relative to said at least one side of the wall part. In determined embodiments the width (b) of the first and second mounting profile is greater than the thickness (d) of the wall part, over the whole length of the mounting profile. In other words, the cloth then extends in principle parallel to said side of the wall part at some distance (a) thereof so that the cloth does not make contact with the surface of said side of the wall part, which may or may not be uneven. In this way a very smooth and uniform view of the wall part can be obtained.

In determined embodiments of the invention the attaching elements are manufactured from metal, preferably sheet steel, and/or the mounting profiles (on which the attaching elements can be arranged) are manufactured from aluminium, preferably extruded aluminium.

In a situation of use the first and/or second coupling element, for instance a coupling slat (on the upper side) or a coupling beam (on the lower side), extend in the receiving spaces of two or more adjacent wall modules in order to prevent mutual slanting of the wall parts. The two coupling elements preferably have receiving spaces with forms and dimensions such that the relevant coupling elements can be placed fittingly therein in order to couple adjacent wall parts with as little mutual clearance as possible.

In determined embodiments of the invention at least one of the first and second attaching element of a wall part is spring-mounted on the wall part for the purpose of tensioning the cloth between the attaching elements under spring tension. The spring tension required for tensioning the cloth tautly in front of the wall part can be produced by the spring-mounting of one of the cloth attaching elements (or of both cloth attaching elements). In this situation the cloth can optionally be a non-elastic cloth. When the cloth however has suitable elastic properties, the required spring tension can be derived from the cloth itself and the cloth attaching means need not be spring-mounted on the wall part. In a determined preferred embodiment the cloth takes the form of a fabric with the following properties: a high elasticity in a first direction and a low elasticity in a second direction, perpendicularly of the first direction. In determined embodiments this essentially means that the cloth can be stretched readily in a first direction while the cloth cannot be stretched, or hardly so, in the second direction, perpendicularly of the first direction.

The cloth is then arranged such that in the first direction it extends from the one cloth attaching element to the opposite, other cloth attaching element. Due to the elastic properties of the cloth in this direction the cloth pulls itself firmly into the attaching means, for instance into the teeth of the cloth attaching elements. In the second direction the cloth has a low elasticity (the fabric can for instance be substantially inelastic in this direction). This reduces the risk of folds in the cloth when it is tensioned between the first and second cloth attaching element.

In determined embodiments the first mounting profile comprises one or more fixing pins for fastening a coupling element to the mounting profile. This is preferably integrated in or attached fixedly to the mounting profile. The person erecting the wall need no longer carry separate attaching means, and no loose attaching means remain behind when the wall is dismantled again. In this respect the walls can thus be reused without waste.

In determined embodiments the system comprises a flexible skirting strip configured to be mounted on at least one lower coupling element and extending in mounted state over substantially the whole width of at least one wall part. A visually acceptable finish of the skirting can hereby be realized in rapid and simple manner, which finish can moreover mask unevennesses or colour variations in the surface of the coupling element.

The flexible skirting strip comprises particularly a strip of fabric, for instance carpet material. The flexible skirting strip is further preferably available as a roll so that a skirting strip of any desired length can be realized in simple manner.

In further embodiments of the modular wall system one or more drilled holes are provided in the side surfaces of adjacent wall parts. These are positioned such that they connect to each other when the wall parts are placed against each other. The modular wall system further comprises an aligning element which is configured to be arranged simultaneously both in a first drilled hole in a side surface of a first wall part and in a second drilled hole positioned opposite the first drilled hole. In this way the aligning elements form an additional coupling between the wall parts.

In a determined embodiment the aligning element comprises:

- a cylindrical pin with a first pin part which can be slid substantially fittingly into the first drilled hole in a side surface of a first wall part and an opposite second pin part which can be slid substantially fittingly into a second drilled hole in a side surface of an adjacent second wall part, wherein, preferably:
- an upright annular flange is provided between the two pin parts;
- the free outer ends of the two pin parts take a pointed form; and/or
- friction elements, for instance in the form of a number of parallel annular flanges transversely of the peripheral surface, are provided.

In other embodiments the modular wall system comprises a coupling piece for the purpose of attaching a wall part to one or more other wall parts at an angle.

According to yet another aspect of the invention, a method for erecting a modular wall system is provided, wherein the method comprises of:

- placing wall parts of a number of wall modules on a ground surface;
- mutually coupling the wall parts;
- attaching a first part of the cloth with one of the first or second cloth attaching element.

The method preferably comprises of first attaching the first part of the cloth to a first cloth attaching element and then attaching a second part of the cloth to a second cloth attaching element.

In determined embodiments the method comprises of attaching a part of the cloth to a first coupling element, preferably by nailing or stapling the first part to the coupling element, and then attaching a second part of the cloth to a cloth attaching element, preferably by hooking the second part of the cloth onto the cloth attaching element.

After the cloth has been attached to the first attaching element and/or when the cloth has been attached to the first coupling element, the cloth can be stretched and can be attached—in stretched state—to the second attaching element. The method can further comprise of placing a first coupling element on the ground surface, placing one or more wall parts on the first coupling element and placing a second coupling element on the one or more wall parts.

In determined embodiments the method comprises of mutually attaching adjacent wall parts by placing a first coupling element in the first mounting profiles of the adjacent wall parts and placing a second coupling element in the second mounting profiles of the adjacent wall parts, wherein a mounting profile in each case extends in at least both a mounting profile of a first wall part and in a mounting profile of a second, adjacent wall part. Not only can the desired attachment or coupling take place in this way, the wall parts are also aligned relative to each other.

In determined embodiments the method comprises of arranging a strip of flexible material on the visible side of one or more coupling elements over substantially the whole width of a wall part.

Placing a wall part on the first coupling element can comprise of sliding a first mounting profile, mounted or formed on the underside of the wall part, over the first coupling element. Placing a second coupling element on a wall part can comprise of sliding the second coupling element into a second mounting profile mounted or formed on the upper side of the wall part.

In determined embodiments of the invention the method comprises of:

- attaching, preferably hooking, the cloth to the second attaching element;
- pulling the cloth along the wall part in the height direction; and
- attaching, preferably hooking, the cloth pulled along the wall part to the first attaching element.

BRIEF DESCRIPTION OF THE DRAWINGS

Further advantages, features and details of the present invention will be elucidated on the basis of the following description of the only embodiment thereof. Reference is made in the description to the accompanying figures, in which.

DETAILED DESCRIPTION

Figure 1:
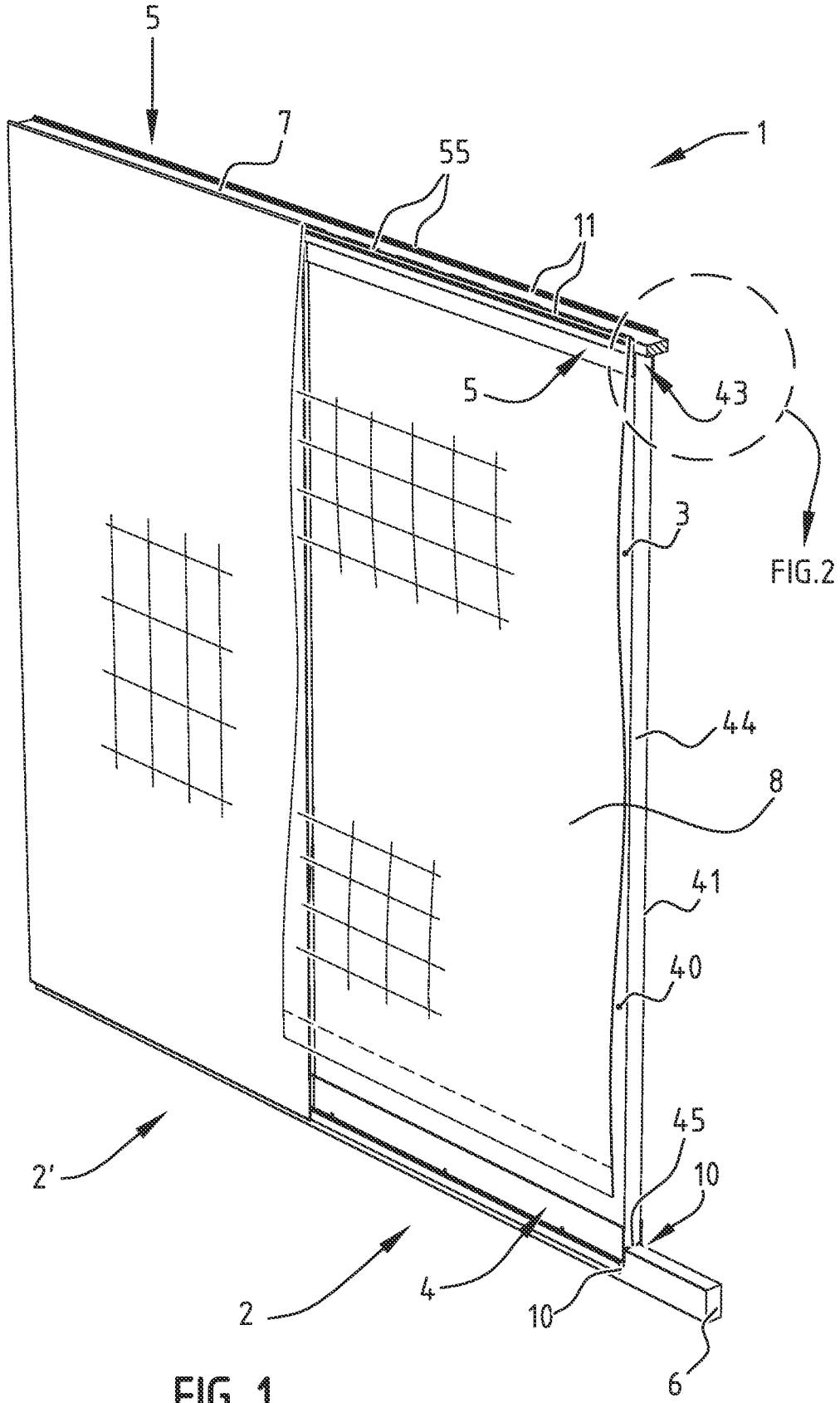
FIG. 1 is a perspective view of two mutually coupled wall parts of a modular wall system according to an embodiment of the invention.

FIG. 1 shows a modular wall system 1 which in the shown situation is constructed from two wall modules 2, 2'. The two wall modules 2, 2' are arranged adjacently of each other and are furthermore coupled to each other in the manner to be described here. It will be apparent that the wall system can also consist of a single wall module or that the wall system is constructed from more than two wall modules. Furthermore, it is not the case that the wall modules need be arranged mutually in line. It is also possible to place the wall modules transversely of each other or in fact at any angle relative to each other, and then couple them to each other.

Figure 3:
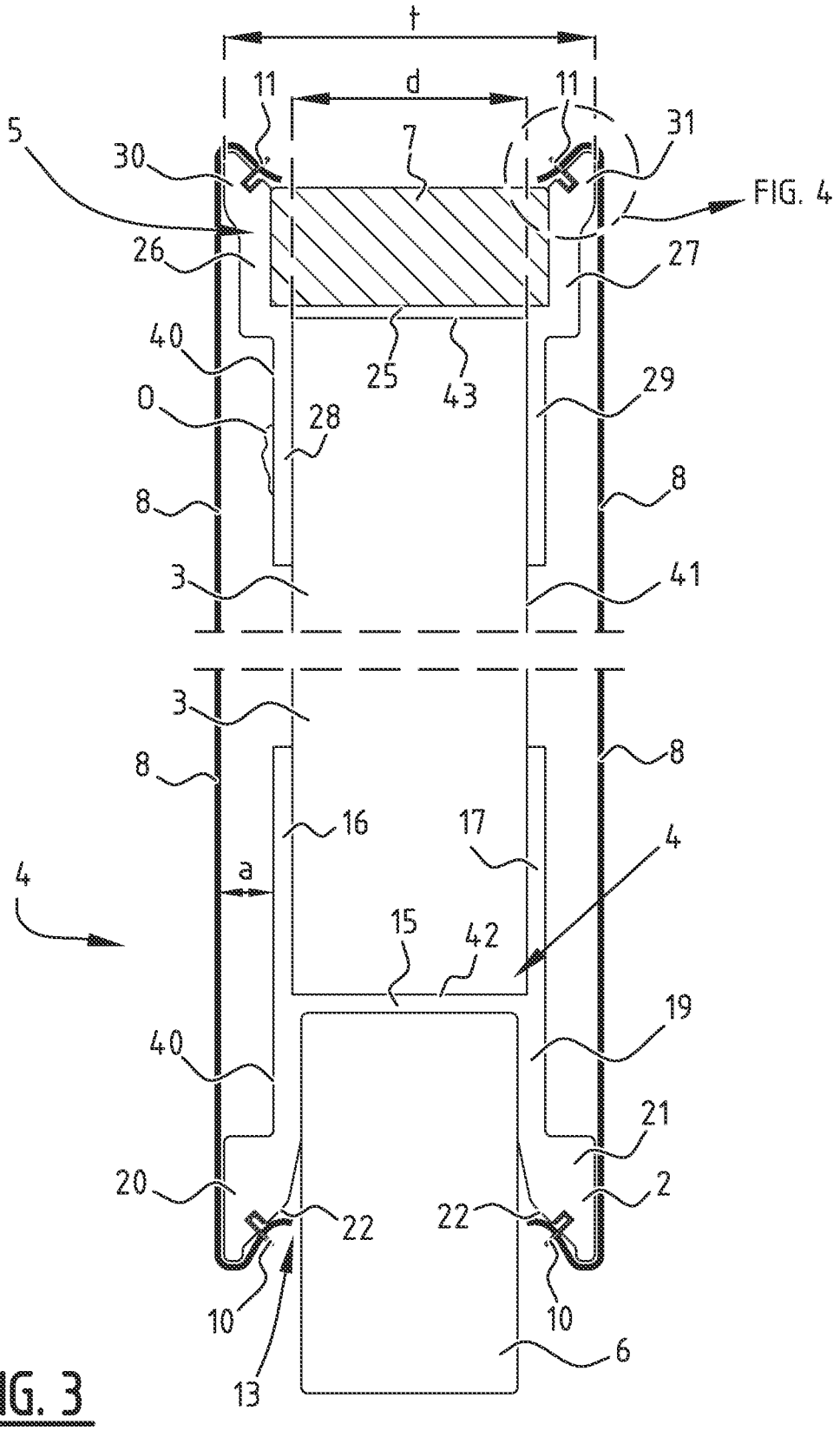
FIG. 3 is a cross-section through a wall part of an embodiment of a modular wall system, wherein the wall part is provided with an upper and lower mounting profile.
Figure 4:
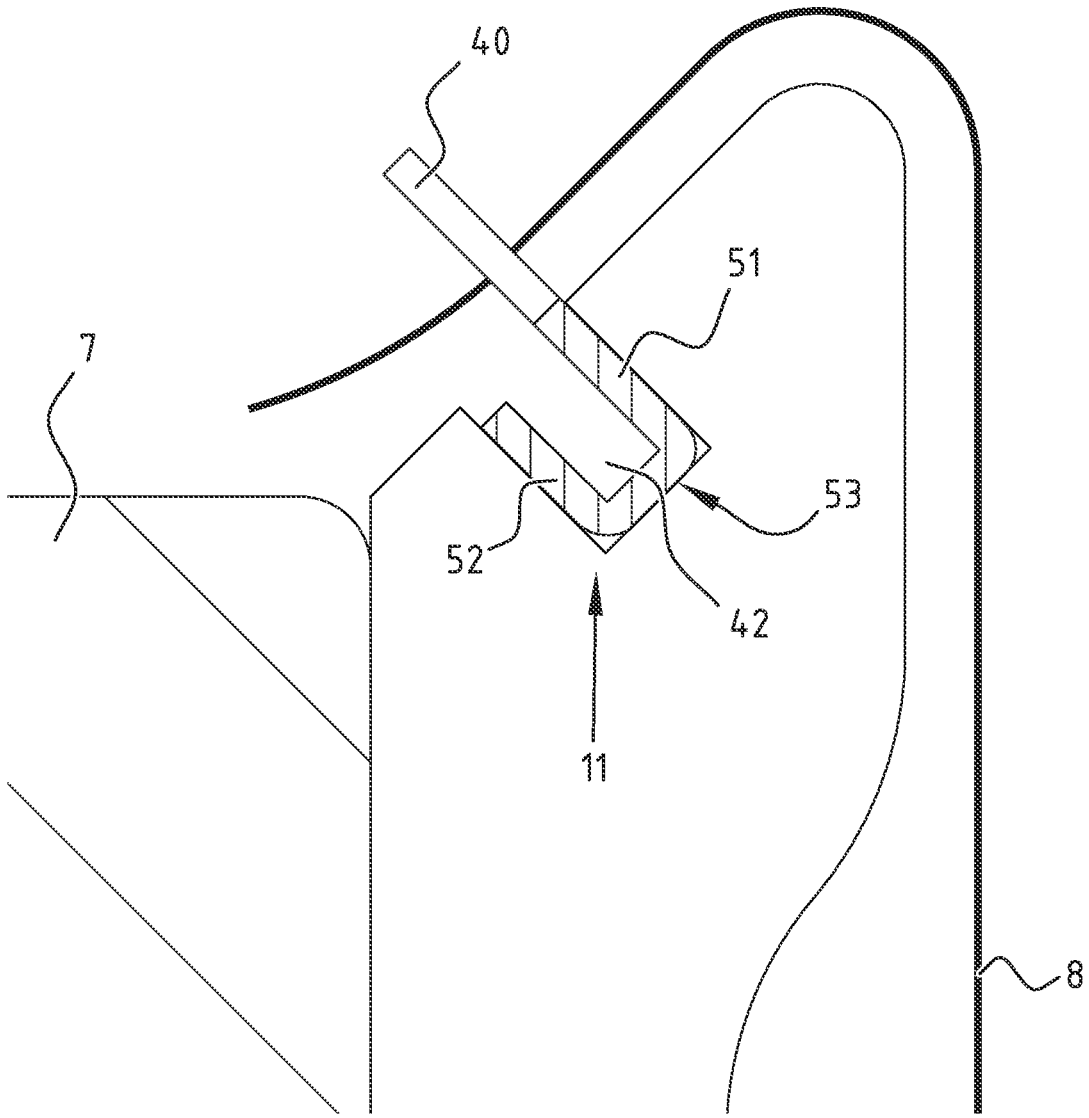
FIG. 4 is a cross-section through the upper end of a wall part, an upper mounting profile and a cloth.

The wall module 2 of FIG. 1 comprises an upright wall part 3, for instance a solid wooden wall, a sandwich construction or a wall with a hollow core, such as a metal stud wall. In the shown embodiment the wall is substantially plate-like and has a front side 40, a rear side 41, a lower side 45, an upper side 43 and two sides 44. In the shown embodiment the wall part 3 has a constant thickness d over the whole height (FIG. 3). In other embodiments the wall can have a varying thickness.

Figure 2:
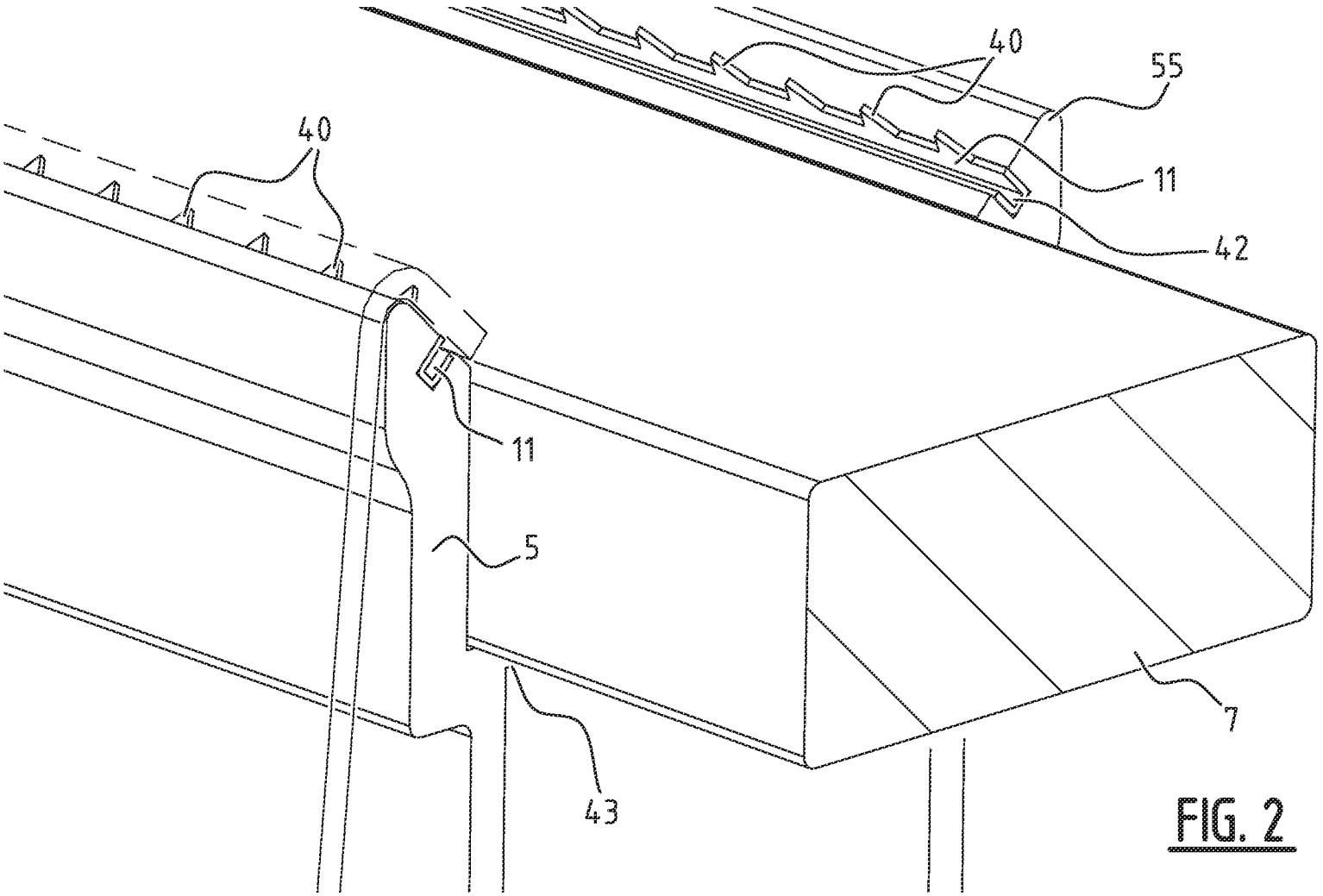
FIG. 2 is a perspective view of the upper end of a wall part provided with an upper mounting profile and two upper attaching elements.

Arranged (as part of wall module 2) on the lower end (adjacently of lower side 43) of wall part 3 is a first (lower) mounting profile 4, while arranged close to the upper end (adjacently of upper side 43) of wall part 3 is a second (upper) mounting profile 5. The mounting profiles 4, 5 are shown in more detail in FIGS. 2 and 3 and in even more detail in FIGS. 5 and 6. In the shown embodiment the lower mounting profile 4 (FIG. 6) has a substantially H-shaped cross-section. The mounting profile 4 comprises a lying profile part 15 and two upright profile parts 16 and 17. A receiving space 9 is formed between the upright profile parts 16 and 17. This has inner dimensions that roughly correspond to those of the lower end of wall part 3, such that the lower end of wall part 3 can slid in the receiving space 9, as shown in FIG. 3. The upright profile parts 16, 17 are further embodied such that the wall can rest in profile 4 in stable manner. Provided on the underside of mounting profile 4, i.e. under the lying profile part 15, are two downward hanging profile parts 18, 19. The downward hanging profile parts 18, 19 form a receiving space 13 which is suitable for arranging therein a coupling element 6 (FIG. 3, for instance a wooden coupling beam or coupling slat). The receiving space 13 is formed such that profile 4 and the wall part 3 arranged therein can be supported in stable manner by coupling element 6. Although the width of the receiving space 9 in the upper part of profile 4 between the upright profile parts 16, 17 has been drawn slightly larger in FIG. 6 than the receiving space 13 between the downward hanging profile parts 18, 19, this is not the case in all embodiments. The receiving space 13 on the underside of mounting profile 4 can be just as wide or even wider than the receiving space 9 in the upper part of mounting profile 4, for instance when more stability must be provided when coupling element 6 is placed on a ground surface. The underside of coupling element 6 takes a substantially flat form so that the wall system can be supported in stable manner on a flat ground surface. Coupling element 6 is further longer than the width of the wall part 3 of module 2. In the shown embodiment the length of coupling element 6 is roughly equal to the collective width of the two modules 2, 2'. In this way the coupling element 6 can serve on one hand as stable support for the two wall parts 3 and on the other can ensure that the wall parts of the different modules 2, 2' are unable to pivot relative to each other. When coupling element 6 is then fastened to mounting profile 4 in any random manner, for instance by stapling, nailing or screwing mounting profile 4 to the coupling element at one or more positions, the two wall parts of wall modules 2, 2' remain firmly coupled to each other.

Two elongate flanges 20, 21 extending radially outward are respectively provided on the downward hanging profile parts 18, 19 of first mounting profile 4. The distance a (FIG. 3) by which the side surface of each of the flanges 20, 21 protrudes relative to the front side 40 (or rear side 41) of wall part 3 is here chosen such that it is greater than the thickness of any unevennesses or protrusions (O, FIG. 3, for instance screws, paint or plaster and so on remaining behind) which may be situated on the front side 40 (or rear side 41) of wall part 3. This has the result (as will be further elucidated below) that a cloth 8 arranged along the front side 40 or rear side 41 of wall part 3 runs in front of the unevenness O so that the unevenness O and the cloth 8 do not touch each other. Cloth 8 can hereby obtain an externally smooth, uninterrupted appearance.

Referring to FIG. 3 in particular, an elongate slot 42 is arranged on the underside of the flanges 20, 21, in the oblique side 22 directed toward coupling element 6 thereof. Respective first attaching elements 10 can be arranged in this slot 42 (this having a substantially rectangular cross-section in the shown embodiment). The form and embodiment of these attaching elements 10 correspond to the forms and embodiment of the attaching elements 11 to be described below, which are provided on the upper side of wall part 3. The function of these attaching elements 10 and 11 will be described below.

A second, upper mounting profile 5 is arranged on the upper side of wall part 3. Referring to FIGS. 2-5, the second mounting profile 5 comprises a lying profile part 25, two parallel downward hanging profile parts 28 and 29 and two parallel upright profile parts 26 and 27. Provided between the upright profile parts 26, 27 is a receiving space 23 in which a second coupling element 7, also referred to here as a coupling slat or coupling beam, can be arranged (see FIGS. 2 and 3). As is the case in the first coupling element 6, the second coupling element 7 preferably extends over two or more mutually adjacent wall parts of adjacent wall modules 2, 2' so that these wall modules 2, 2' remain aligned relative to each other. Although not shown specifically in the drawings, upper mounting profile 5 is provided, more particularly upright profile parts 26, 27 are provided, with a number of openings which enable upper mounting profile 5 to be fastened to second coupling element 7, for instance by stapling, nailing or screwing it to the upper coupling element. Formed once again on the underside of the second mounting profile 5 is a receiving space 39 in which the upper end of wall part 3 can be received. In the embodiment shown in FIGS. 5 and 6 the receiving space 9 in first mounting profile 4 is the same as the receiving space 39 in the second mounting profile 5. In the other embodiments these receiving spaces need however not be identical. In some cases the wall part 3 is thicker on the underside than on the upper side thereof, or vice versa. The relevant receiving space 9 of the first (lower) mounting profile 4 and the receiving space 39 of the second (upper) mounting profile 5 is of course adapted to this situation so that the upper receiving space 39 is then smaller than the lower receiving space.

Figure 7:
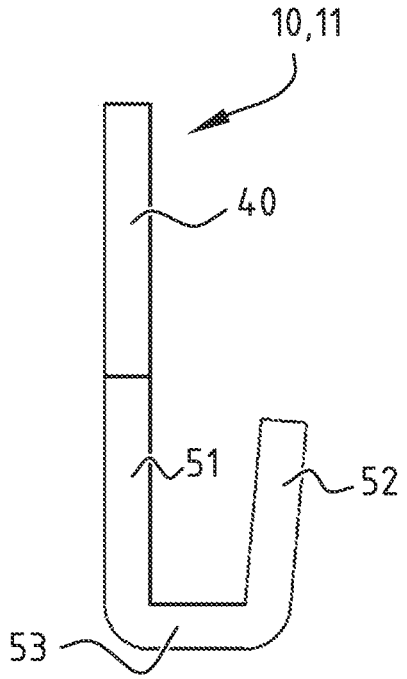
FIG. 7 is a schematic cross-section of the second attaching element.
Figure 8:
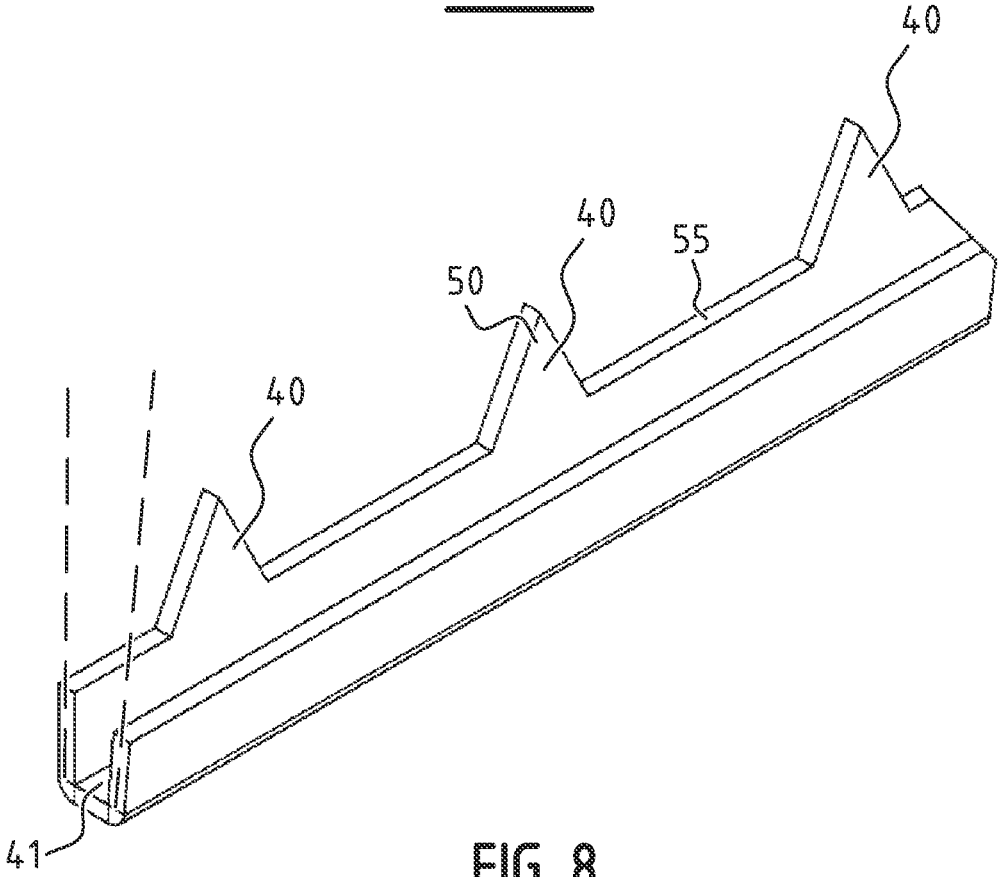
FIG. 8 is a schematic side view of the second attaching element of FIG. 7.

Two respective elongate flanges 30, 31 extending radially outward are provided on the upright parts 26, 27 of the second, upper mounting profile 5, wherein an elongate slot 42 is once again formed in the oblique, inward directed sides of flanges 30, 31. One or more attaching elements 11 are arranged in slots 42. As stated above, in the shown embodiment attaching elements 10 of the first (lower) mounting profile 4 are the same as the attaching elements 11 in the second (upper) mounting profile 5. In the other embodiments, not shown, the attaching elements 10, 11 can also be embodied differently from each other. It is important that both the lower attaching elements 10 and the upper attaching elements 11 are suitable for holding on to the cloth 8 because of their form. In the embodiment as described in the figures, particularly in FIGS. 7, 8, this holding takes place in that the attaching element 10, 11 has a longitudinal edge which is provided with a row of teeth 40. This row of teeth 40 preferably has pointed outer ends 50 which are suitable for protruding wholly or partially through the cloth 8 so that the cloth can be attached firmly to the relevant attaching element 10, 11.

In order to ensure that attaching elements 10, 11 remain retained in the respective slots 42 the legs 51, 52 of the U-shaped bottom part 53 (see FIG. 4) of attaching element 10, 11 are directed obliquely outward relative to each other to some extent. Attaching element 10, 11 hereby clamps fixedly in said slot 42. It will be apparent that attaching element 10, 11 can be mounted on mounting profile 4, 5 in numerous other ways.

In the shown embodiment attaching elements 10, 11 are separate components which can be slid into the slots 42 of mounting profiles 4, 5. This makes it easy to manufacture attaching elements 10, 11 from a different material than mounting profiles 4, 5. In other embodiments (not shown) attaching elements 10, 11 are however integrated with mounting profiles 4, 5 and form a single component therewith.

In the shown embodiments the mounting profiles and attaching elements are separate components. They are manufactured from different materials. While mounting profile 4, 5 itself is manufactured from a relatively lightweight metal, for instance aluminium, attaching elements 10, 11 are preferably manufactured from sheet steel. Sheet steel can be easily formed to obtain the U-shaped base part 41, and it is moreover simple to obtain a row of teeth 40 with suitable mechanical properties in sheet steel.

Figure 9:
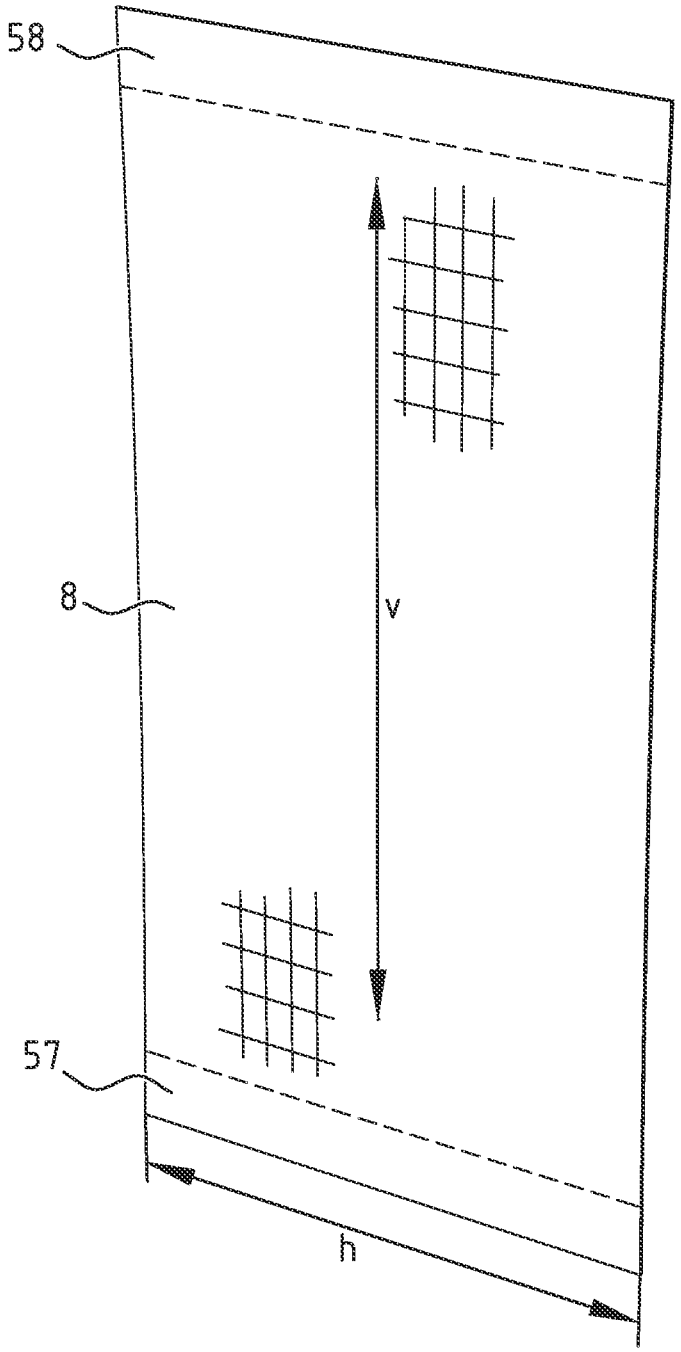
FIG. 9 is a view of a cloth to be arranged on a wall part according to the invention.

FIG. 9 shows an example of the cloth 8 to be tensioned in front of wall parts 3. The cloth 8 is substantially rectangular and comprises an upper attaching area 58 for attaching to the upper attaching element 11 and a lower attaching area 57 for attaching to the lower attaching element 10. Cloth 8 is preferably manufactured from a fabric which is elastic in one direction (in the figure the vertical direction v), while in a second direction (in the figure the horizontal direction h) the cloth is not or is hardly elastic.

FIG. 1 shows how cloth 8 is attached to the modular wall system 1. Firstly, the upper attaching area 58 of cloth 8 is guided over the longitudinal edge 55 of the upper mounting profile 5. By then pulling cloth 8 downward the points 50 of the teeth 40 of attaching element 11 pierce the cloth, this such that the cloth secures itself in attaching element 11. The lower attaching area 57 of cloth 8 is then pulled, this such that the cloth is stretched in height direction (v) to some extent. A downward force is hereby exerted on the upper part of the cloth such that the cloth is pressed firmly into the teeth 40 of the upper attaching element 11 and remains pressed therein. The lower part of the cloth is then guided round the teeth 40 on the lower mounting profile 4 so that the teeth 40 thereof also grip that part of the cloth. As a result of the elastic properties of the cloth (which provide for a kind of spring tension on the upper and lower attaching element 10, 11 in that the stretched cloth has a tendency to return to its original state), cloth 8 will be pulled taut and remain tensioned tautly between the two attaching elements 10, 11.

Owing to the outlined high degree of elasticity of cloth 8 in vertical direction the cloth 8 secures itself in attaching elements 10, 11 without manual operations such as stapling, nailing or screwing being necessary. The elasticity in horizontal direction is considerably lower. Elasticity in the horizontal direction is not needed because the cloth already remains tautly tensioned between the upper and lower attaching elements 10, 11. Not making cloth 8 elastic in horizontal direction also reduces the risk of folds in cloth 8.

As shown in FIG. 3, owing to the shown construction of lower and upper attaching elements 10, 11 and owing to the properties of the cloth itself the cloth 8 is pulled taut at some distance (a) relative to the relevant surface (side 40, 41) of wall part 3. This gives the wall part a smooth and uniform appearance. It is further noted that in the embodiment shown in FIG. 3 the cloth 8 is arranged on only one side of wall part 3. It will be apparent that this cloth can also be arranged on the other side, i.e. the rear side 41, or on both front side 40 and rear side 41.

Figure 6:
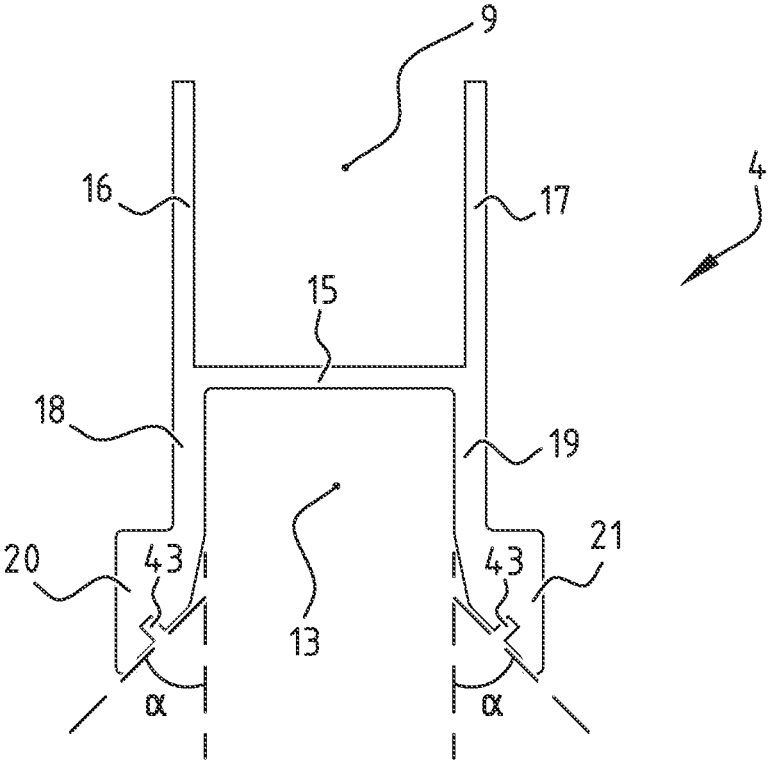

Referring to FIG. 6, the oblique surface 22 of radial flanges 20, 21 of the first (lower) mounting profile 4 is directed such that an angle $\alpha$ is defined between the direction of the teeth 40 and the relevant side (front side 40 or rear side 41) of wall part 3. A similar angle $\alpha$ can be defined between the direction of the teeth 40 of upper attaching element 11 of upper mounting profile 5 and the same side (front side 40 or rear side 41) of wall part 3. This angle $\alpha$ preferably lies between 30 and 60°, preferably 45°. It has been found that it is precisely at an angle $\alpha$ in this relevant angular range that outstanding attaching properties of the attaching elements 10, 11 can be realized on the one hand, while the other hand there is sufficient space for the person erecting the walls (i.e. space between the lower profile 4 and the lower coupling element and space between the upper profile 5 and the upper coupling element) to guide cloth 8 easily over the teeth. In this way a single person can attach a cloth very tautly along the relevant surface of wall part 3 so that wall module 2 obtains the desired appearance in relatively rapid manner and without much skill being required.

In other embodiments (not shown) the attaching elements 10, 11 are not arranged fixedly on the relevant mounting profiles 4, 5, but a spring-mounting is provided. This is understood to mean that attaching elements 10, 11 are mounted such that the respective teeth 40 can be pressed inward to some extent and can spring back again. Instead of deriving the necessary spring tension only from cloth 8, at least a part of the spring tension can be realized by the spring-mounting of the attaching elements 10, 11. It is even possible to apply a cloth 8 which is not elastic at all, so that the desired spring tension is realized wholly by the relevant attaching elements 10, 11. In a further embodiment only one of the two attaching elements 10, 11 is arranged spring-mounted on the relevant profile 4, 5, and the other attaching element is arranged fixedly on the relevant profile. In this embodiment the one resilient attaching element 10 or 11 can also provide for sufficient spring force (tensioning force) to attach the cloth between the two attaching elements and tension it tautly.

It is described in an above described embodiment that the upper coupling element 7 extends along two or more adjacent wall parts 2, 2'. Alternatively or additionally, it is also possible to have the lower coupling element 6 extend over two or more wall modules 2, 2' in this way. When the lower coupling element 6 is for instance embodied longer than the width of a wall part 2, 2', first coupling element 6 will extend not only in the receiving space of the relevant wall part but also in a receiving space of at least an adjacent wall part. In this way it is ensured that the bottom end of mutually adjacently placed wall parts also remain neatly aligned. It is further possible to fasten the lower profile 4 to the relevant lower coupling element 6, for instance by stapling lower profile 4 to lower coupling element 6.

Figure 5:
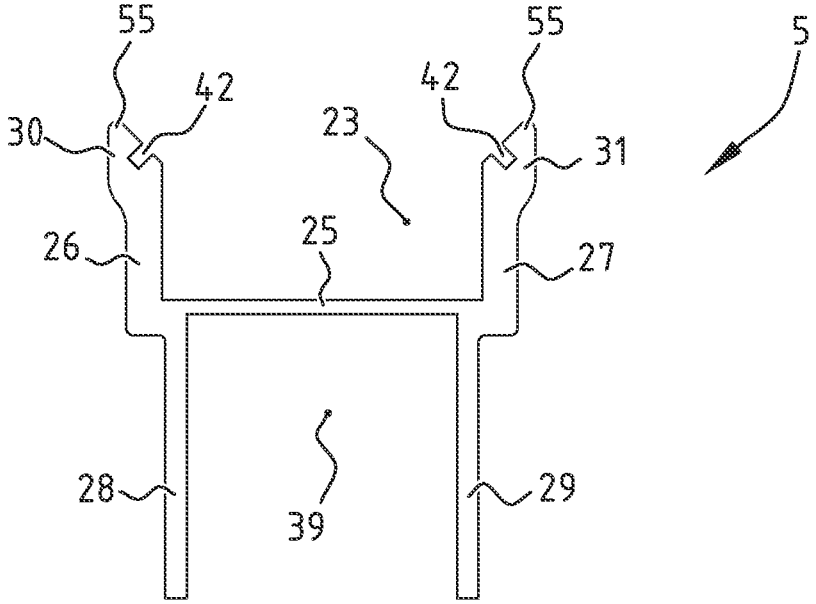
FIGS. 5 and 6 are cross-sections of respectively the upper mounting profile and the lower mounting profile.
Figure 10:
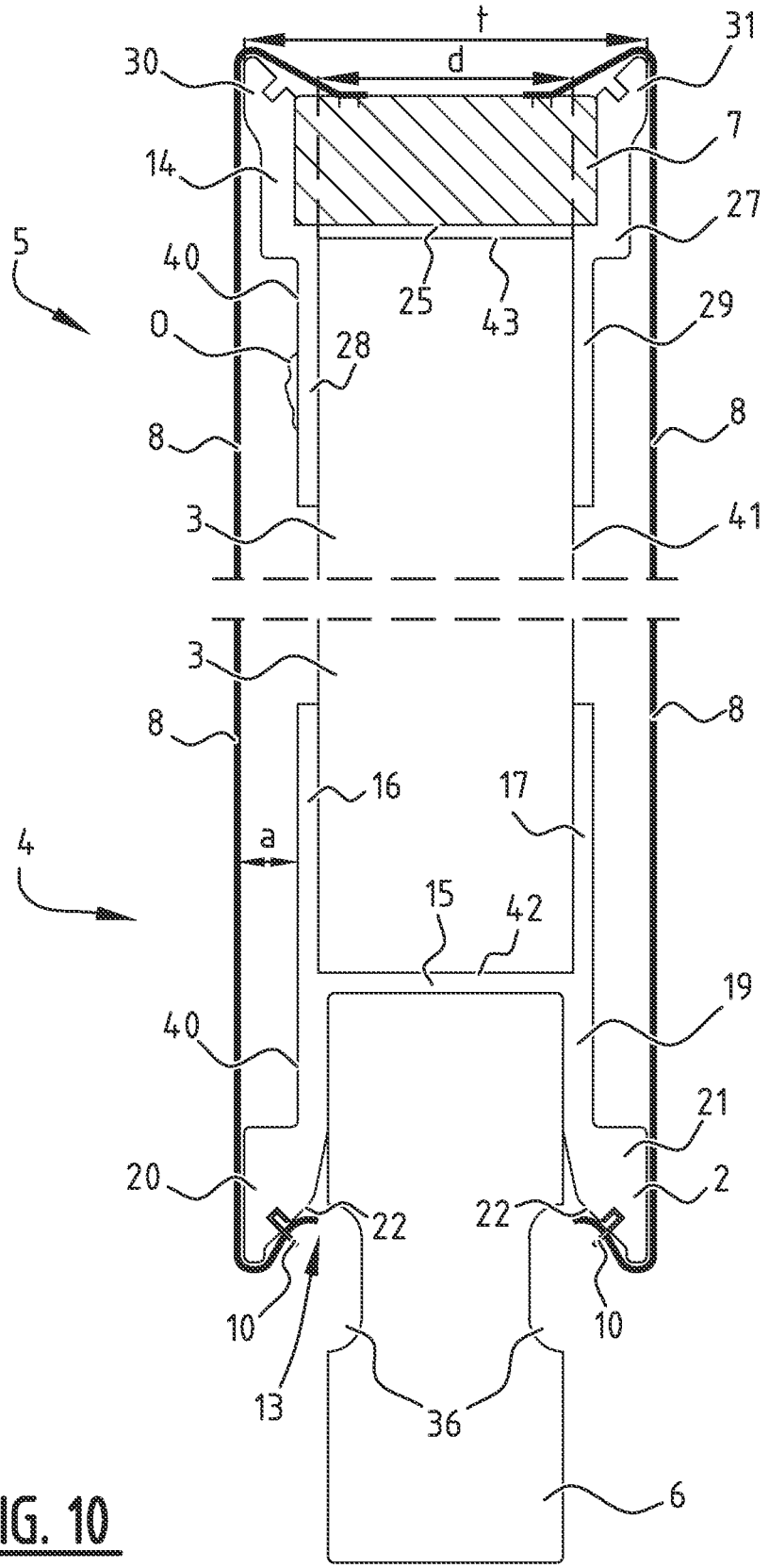
FIG. 10 is a cross-section through a wall module of a further embodiment of a modular wall system, wherein the wall part of the wall module is provided with a differently embodied upper and lower mounting profile and with a different lower coupling element.
Figure 11A:
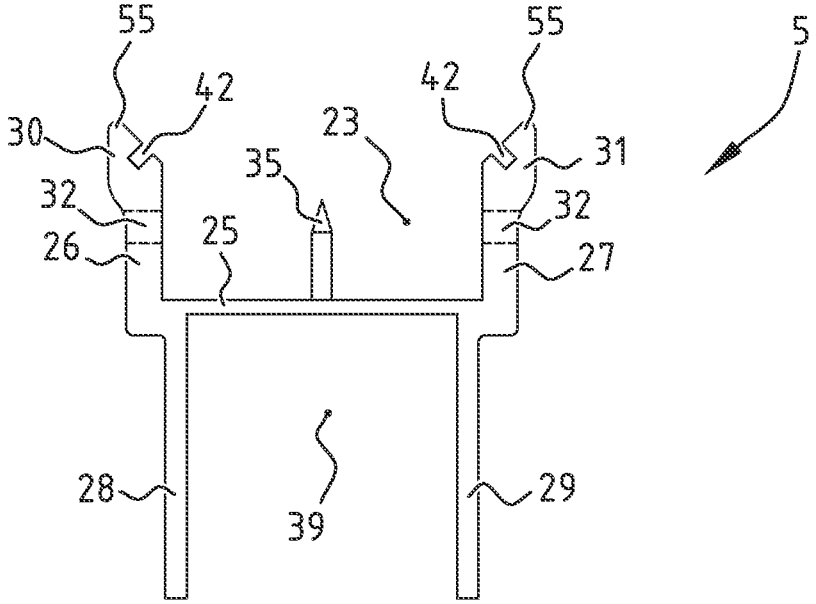
FIGS. 11A and 11B are cross-sections of respectively the upper mounting profile and the lower mounting profile of still further embodiments.
Figure 11B:
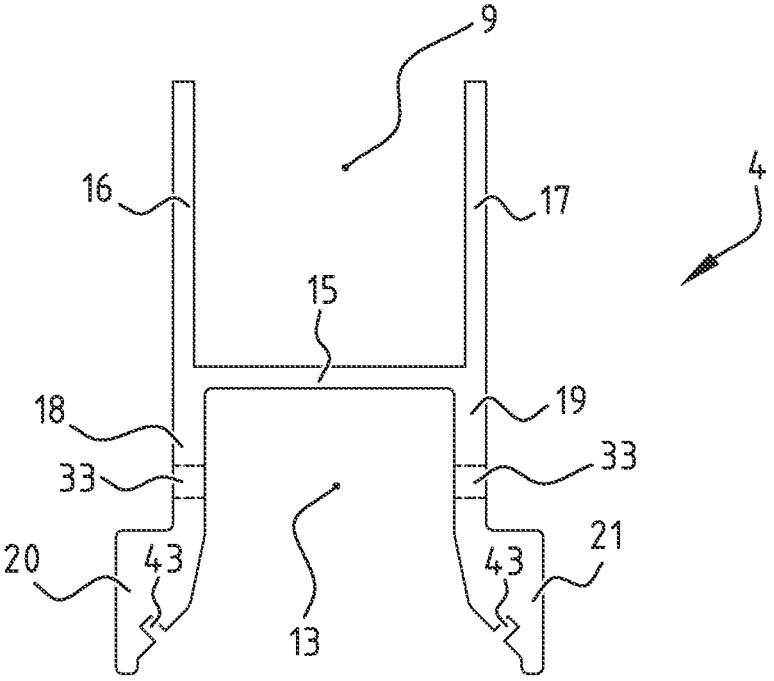

FIGS. 10, 11A and 11B show embodiments corresponding with those of FIGS. 3, 5 and 6, with the exception of differently embodied upper and lower mounting profiles (wherein the upper mounting profile entails a different manner of attaching the cloth) and of a differently embodied lower coupling element. The same reference numerals also refer to the same components. It will otherwise be apparent that the differently embodied lower coupling element and/or the differently embodied lower mounting profile and/or the differently embodied upper mounting profile can be applied in the above described embodiment of FIGS. 1-9.

FIGS. 10 and 11A show that the attaching elements 11 arranged in the respective slots 42 of the upper mounting profile 5 have been dispensed with in the further embodiment. In the shown embodiment the slots 42 can remain empty, since the cloth 8 is attached to wall module 2 in an alternative manner to be described below. In other embodiments (not shown) an upper mounting profile is embodied without slots 42, since in this embodiment the slots no longer have any function for attaching the cloth to the profile.

As shown in FIG. 10, cloth 8 is now attached to wall module 2 by folding the upper edge of the cloth over the upper edge of the relevant flange 30, 31 of mounting profile 5 and arranging the outer end of the cloth on the upper coupling element 7, for instance by attaching the cloth thereto with fastening means such as staples 54.

FIG. 11A (and FIG. 12, at the position of the portions 49 removed only for the drawings) shows an embodiment of the upper mounting profile 5 in which the (lying) profile part 25 is provided with one or more fixing pins 35 extending at right angles to the surface of the profile part 25 and provided with a pointed end. The fixing pins 35 can be embodied as reverse nails forming one whole with the rest of profile 4, as shown in the figure. Other embodiments are however likewise possible.

In the shown embodiment the fixing pin 35 is further provided in the centre (in cross-section) of mounting profile 5, in other embodiments the fixing pin 35 can lie outside the centre and/or two or more fixing pins are distributed over the width of profile part 25. It is preferred to arrange two or more fixing pins 35 per mounting profile, for instance in a row of fixing pins which are distributed uniformly over the length of the mounting profile to greater or lesser extent. Fixing pins 35 enable the coupling elements 7 (usually embodied in wood or similar material) to be attached to mounting profile 5 in simple manner by placing coupling element 7 on fixing pin 35 and then pressing coupling element 7 over fixing pin 35. It is hereby no longer necessary to arrange fastening means in coupling element 7 from above. Fastening coupling element 7 with nails to be nailed manually is thus no longer necessary. This will potentially result not only in less work for the persons having to erect the wall system but also saves on waste, since no more loose nails or the like remain afterward requiring discarding (possibly together with the coupling element 7 in which they are arranged).

Although it is thus no longer necessary in determined embodiments to apply separate fastening means in addition to the fixing pins 35, holes 32 (preferably a row of holes distributed uniformly over the length of mounting profile 4 to greater or lesser extent) are however also arranged in the side walls 26 and 27 of the embodiment shown in FIG. 11B. (Further) fixing means such as nails or screws can be arranged in these holes in order to fix mounting profile 5 relative to coupling element 93. In other embodiments these holes have been dispensed with.

The above stated fixing pin will generally not be present in the lower mounting profile 4. When assembling the wall, the wall part is slid over the lower mounting profile, for instance to a position against the adjacent wall part (to the extent this is present). The sliding would be counteracted by the presence of such a fixing pin.

FIG. 10 also shows that the lower coupling element 61 is embodied differently. Coupling element 6 comprises elongate recesses 36 on either side (or, in other embodiments which are not shown, on only one side). These recesses have a form and dimensions such that they provide (more) space for the hands of the person pulling the cloth tautly over the wall part and attaching it thereto. The lower coupling element 61 can otherwise correspond wholly with the above described coupling element 6.

FIG. 11B shows a variant of the lower mounting profile 4. The figure shows that mounting profile 4 is provided with holes 33 (preferably once again a row of holes arranged uniformly over the length of mounting profile 4 to greater or lesser extent). Fixing means such as nails or screws can be arranged in these holes in order to fix mounting profile 4 relative to the coupling element 6, 61 (mainly to prevent coupling element 6, 61 from being able to shift relative to mounting profile 4).

Figure 12:
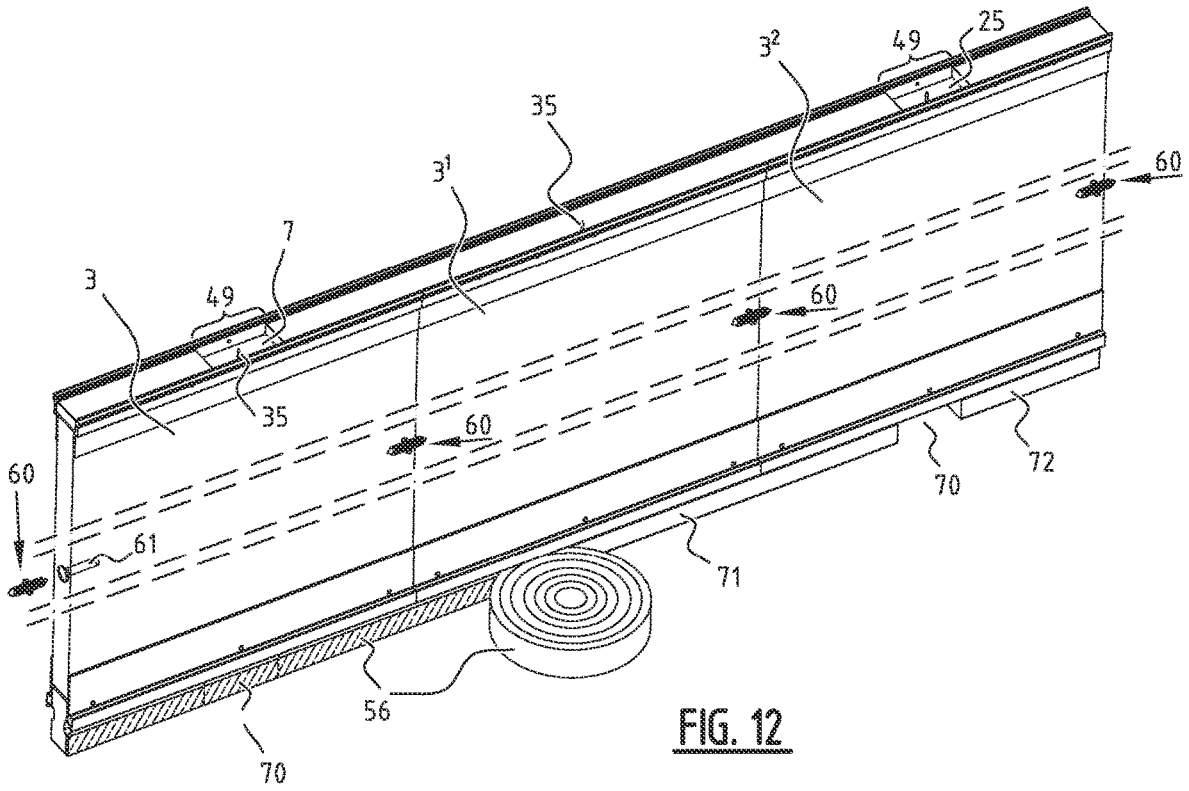
FIG. 12 is a side view of an embodiment wherein the lower side of the wall part is finished with a flexible strip and wherein wall parts are additionally connected to each other via a number of aligning elements in sides of the wall parts.

In determined embodiments the lower coupling element 6 also forms the skirting of the wall. In other embodiments or situations a separate, usually wooden or plastic, finishing skirting board is mounted on the visible side of coupling element 6 in order also to give the lower side of the wall a more attractive appearance. FIG. 12 shows yet another embodiment in which a strip 56 (also referred to hereinafter as the skirting strip) of flexible material, for instance in the form of a strip of fabric such as carpet material, is arranged against the visible side of the lower coupling element 6. The strip 56 can be attached to the coupling element 6 (in the shown embodiments coupling elements 71, 72) using staples, nails, screws and the like and/or can be glued to the visible side of the coupling element. In some embodiments the strip 56 of flexible material comprises an adhesive such as a glue layer whereby the strip can be adhered fixedly to the coupling element 6. Such an (adhesive) strip can be arranged in rapid and simple manner. In other embodiments a separate glue layer is applied in situ between the strip 56 and the outer side of coupling element 6, for instance on an outer side of the coupling element (wherein the glue layer therefore does not form part of strip 56), after which the strip 56 can be arranged.

An advantage of using such a strip 56 of flexible material is that it can be easily arranged and can also be removed again more easily after use, without mounting material remaining or having to remain as waste in principle. A further advantage is that any unevennesses (protrusions, notches, discolorations and so on) on the outer side of coupling element 6 are automatically covered and are therefore no longer visible. This for instance also means that coupling elements 6 can now be used several times (for different walls), while the coupling elements would otherwise have to be labelled waste after every use.

A further advantage is also that an intermediate space which occurs in determined situations between adjacent coupling elements, for instance the intermediate space 70 between adjacent coupling elements 71 and 72 of FIG. 12, can be concealed from view: after the strip 56 of flexible material has been arranged the intermediate space 70 is no longer visible, at least not from the visible side. This concealing from view of the intermediate space 79 present between coupling elements 71 and 72 further also has a number of significant positive consequences. It is no longer necessary to saw the coupling elements 6, 71, 72 precisely to size in order to ensure that they connect neatly to each other in a determined wall construction. Not only does this save a great deal of work time, it also enables application of coupling elements 71, 72 of different lengths, which may or may not have been used previously. In practice this means a considerable saving in the amount of coupling elements needed to erect a wall and a saving in transport costs, but it also means that a lot less waste, or in principle even no waste whatsoever, is created now that the same coupling elements can be utilized time and again and in more versatile manner.

Figure 14A:
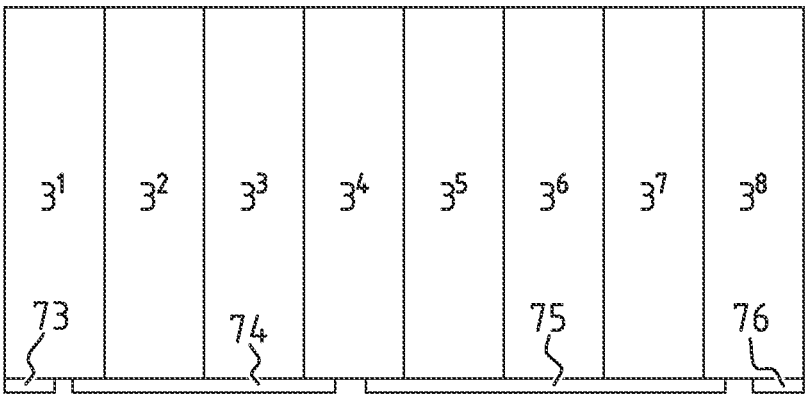
FIGS. 14A-14D are views of a number of aligned and mutually coupled wall parts positioned adjacently of each other and respectively provided with lower coupling elements which are arranged in non-connecting manner and have diverse lengths.

Examples hereof are shown in FIGS. 14A-14D. FIG. 14A shows eight wall parts $3^1$-$3^8$ placed adjacently of each other and coupled to each other with lower coupling elements 73-76 (wherein the upper coupling elements are not shown in the figures for the sake of simplicity). Coupling elements 73 and 76 have a relatively small length, coupling element 75 has a relatively great length, and coupling element 74 has a length lying therebetween. All wall parts $3^1$-$3^8$ can be mutually coupled with said coupling elements, wherein on the one hand there must always be a coupling element at the position of the connection between two adjacent wall parts in order to obtain the correct coupling and wherein on the other hand there must always be one or two coupling elements which continue up to the free side surfaces 44 of the wall, so here side surfaces of wall part $3^1$ and wall part $3^8$, in order to ensure that the above stated continuous skirting strip 56 can continue over the whole length of the assembled wall.

Figure 14B:
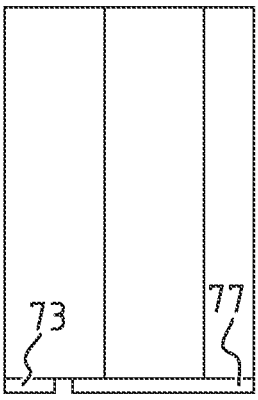
Figure 14C:
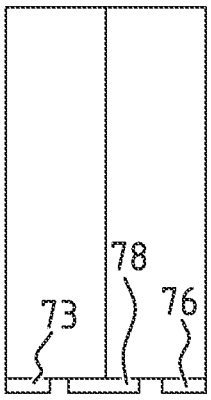
Figure 14D:
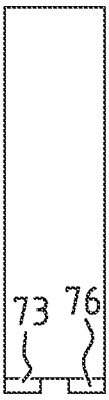

FIGS. 14B, 14C and 14D show further examples of coupling elements 77 and 78 which in turn have lengths differing from those of the above stated coupling elements 73-76.

Figure 13:
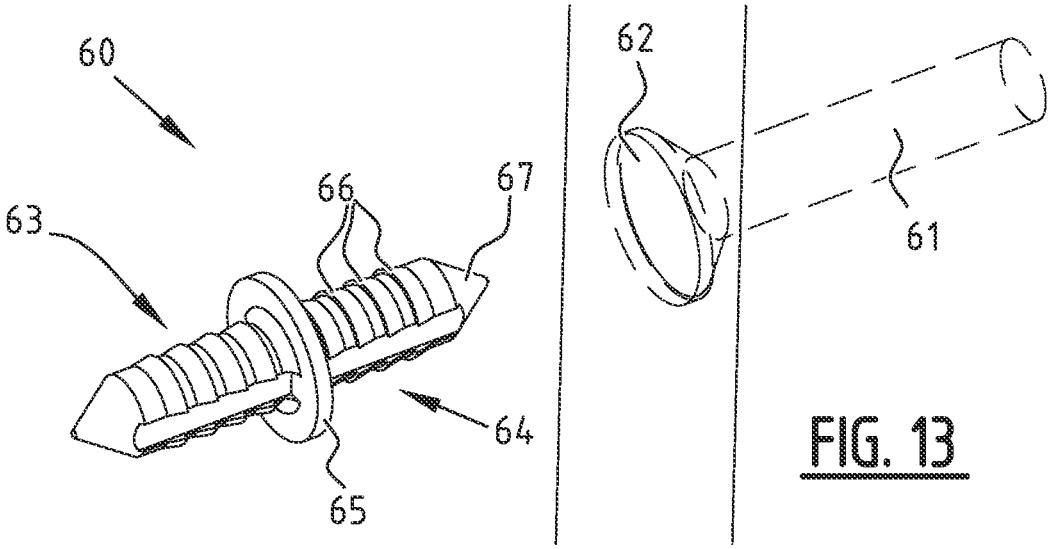
FIG. 13 is a perspective view of an aligning element used for mutually aligning wall parts positioned adjacently of each other.

In the above described embodiments mutually adjacent wall parts 3, 3' of wall modules 2, 2' are mutually coupled to each other only by the upper coupling element 7 and the lower coupling element 6. In all the above stated embodiments it is however also possible to apply (optional) aligning elements whereby wall parts are additionally coupled to each other. Examples of such aligning elements 60 are shown in FIGS. 12 and 13. In the shown embodiment a coupling element 60 comprises a cylindrical pin 64 with a first pin part 63 which can be slid substantially fittingly into a first drilled hole in a side surface 44 of first wall part 3 and an opposite second pin part 67 which can be slid substantially fittingly into a second drilled hole 61 in a side surface 44 of an adjacent second wall part 3'. Provided between the two pin parts 63 and 67 is an upright annular flange 65 which ensures that the pin parts 63, 67 cannot be slid too far into a drilled hole 61. The free outer ends of the two pin parts 63, 67 take a pointed form and the opening of drilled hole 61 has a chamfered peripheral edge 62. The pointed form in combination with the chamfered peripheral edge 62 simplify arrangement of coupling element 60 in the drilled holes 61 lying opposite each other. The two pin parts 63, 67 can have a smooth periphery, although in the shown embodiment the peripheral surfaces of the two pin parts 63, 67 are provided with a number of friction elements 66, for instance in the form of a number of parallel annular flanges transversely of the peripheral surface of the pin parts, in order to hold a pin part 63, 67 in place once it has been slid into a drilled hole 61. In the situation shown in FIG. 2 side surface 44 of a wall part 3, 3' is provided with one single coupling element 60. In other situations more than one coupling element can of course be provided per side surface of a wall part, wherein the coupling elements are then preferably—though not necessarily—positioned distributed uniformly over the height of side surface 44.

Figure 15:
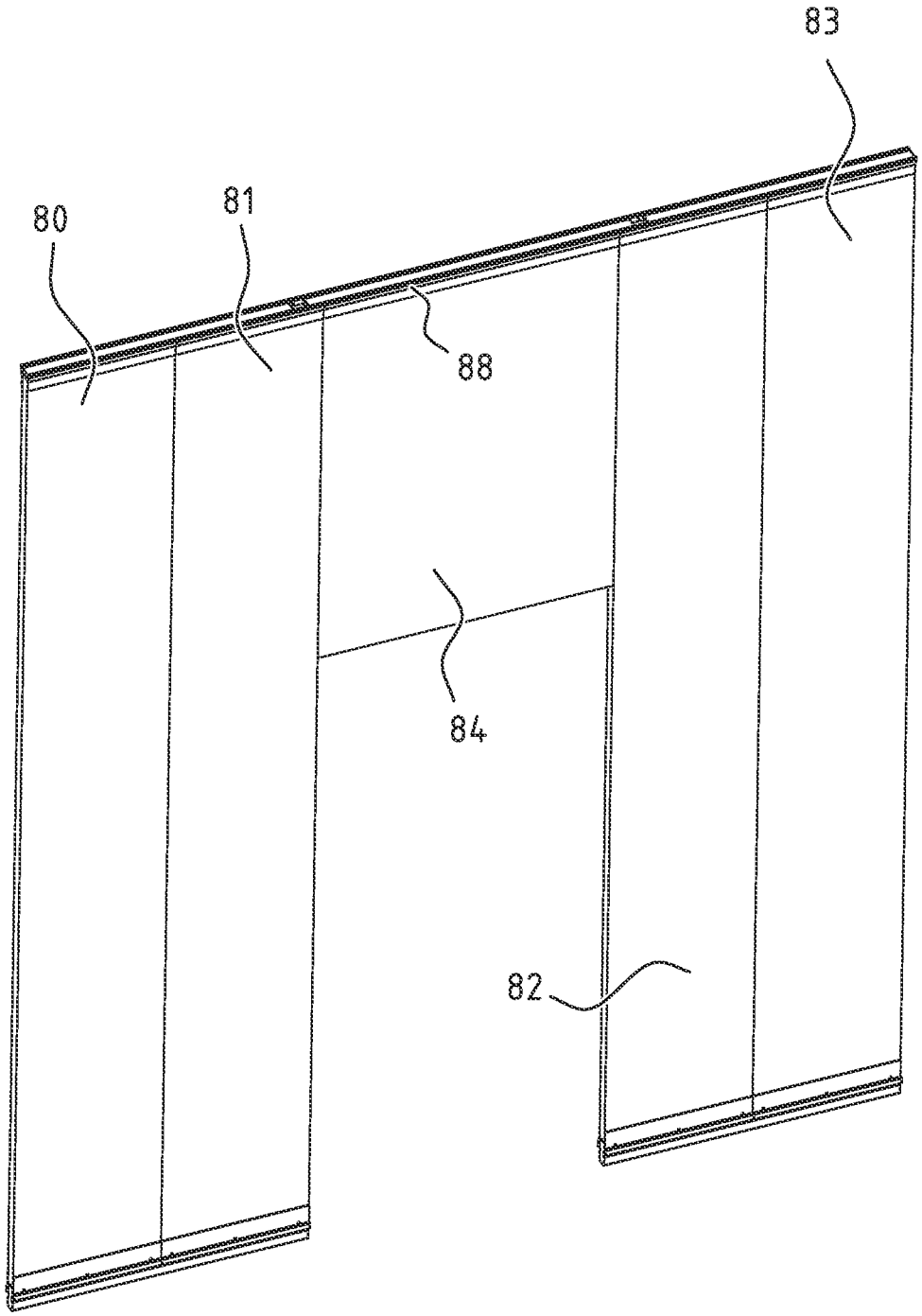
FIG. 15 is a perspective view of a further embodiment of a flat wall with door opening.

FIG. 15 is a perspective view of a further embodiment of a flat wall, wherein the wall consists inter alia of a number of wall modules placed mutually in line, wherein a wall part of one of the wall modules is shorter and is attached to adjacent wall parts only on the upper side, for instance for the purpose of forming an opening in the wall, such as a window or door opening. The wall comprises a first wall part 80, second wall part 81, third wall part 82, fourth wall part 83 and fifth wall part 84. Fifth wall part 84 is identical to the other wall parts, except for the fact that the height of fifth wall part 84 is smaller than that of the other wall parts and that fifth wall part 84 is coupled via an upper mounting profile 88 (FIG. 16) to the adjacent wall parts 81 and 82 only on the upper side (wherein the upper mounting profile 88 can be identical to one of the above described embodiments of the mounting profile 4). The smaller height of the fifth wall part 84 enables an opening to be formed in the wall, for instance—though not limited to—a door opening.

Figure 16:
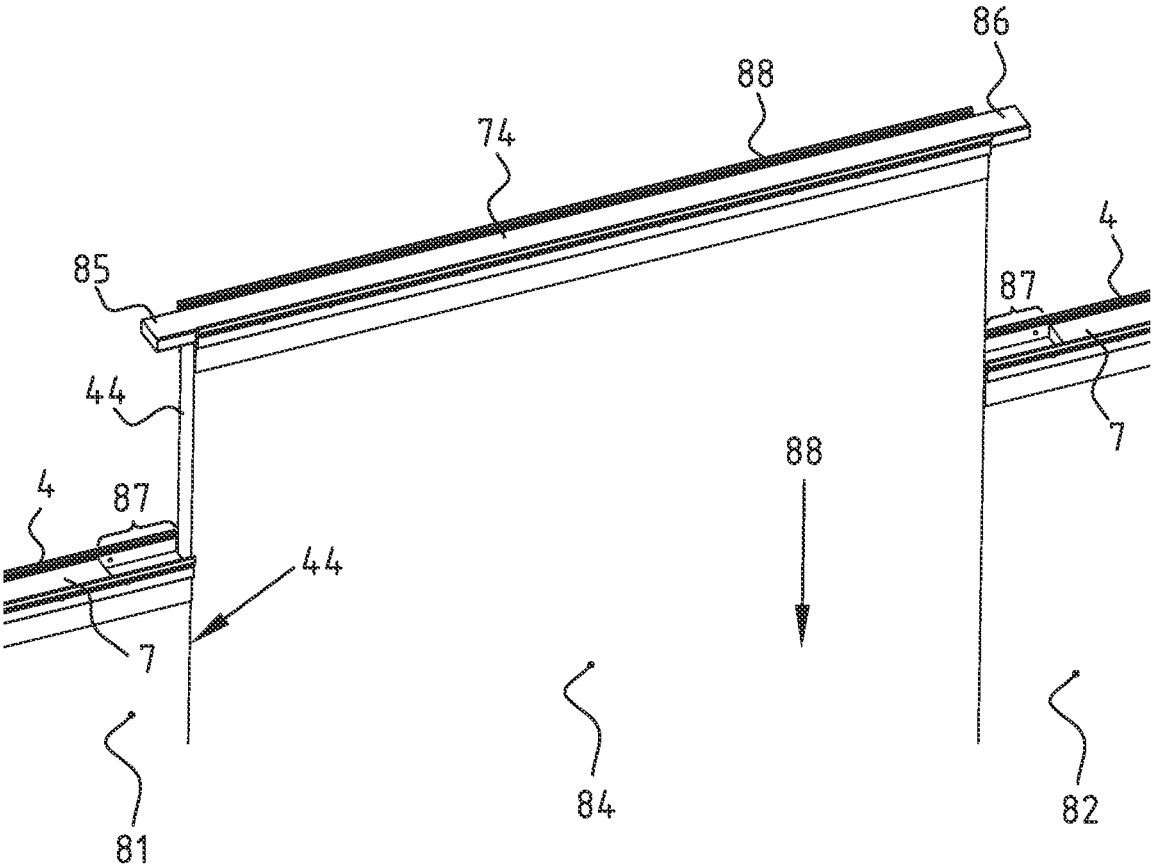
FIG. 16 is a more detailed side view of the wall of FIG. 15, in a position just before said one wall part is coupled to the two adjacent wall parts.

FIG. 16 is a more detailed view of the wall of FIG. 15 and shows how the wall can be assembled. The figure shows the wall in a position just before said short wall part 84 is coupled to the two adjacent wall parts 81 and 82. Wall parts 80 and 81 and wall parts 82 and 83 are first couple to each other in the usual manner, i.e. via the respective upper mounting profiles 4 of each of the wall parts 80-83, lower mounting profiles 5, upper coupling elements 7 and lower coupling elements 6, 61. As shown in FIG. 16, the upper coupling elements 7 in the attaching element 4 of second wall part 80 and the upper coupling elements 7 in the attaching element 4 of third wall part 82 do not extend up to the respective side surfaces 44. The intermediate spaces 87 between each outer end of coupling element 7 and the associated side surface 4 is sufficient for receiving therein the outer ends 85, 86 of a coupling element 74 of fifth wall part 84 which lie opposite each other and protrude beyond the respective side surfaces 44 of fifth wall element 84.

During assembly the fifth wall part 84 is placed between wall parts 81 and 82, the coupling element 85 (which in determined embodiments corresponds wholly with one of the above stated embodiments of mounting profile 4) is then arranged in the attaching element, for instance by sliding it onto one or more fixing pins 35 of mounting profile 4, and the whole is displaced downward (direction 88) until coupling element 74 comes to lie in the mounting profiles 4 of the adjacent wall parts 81, 82. Coupling element 74 can be fastened (fixed) to these mounting profiles 4 by means of the fixing pins 35 (not shown). During dismantling the fifth wall part 84 need only be pushed in opposite direction in order to uncouple wall part 84 from the adjacent wall parts 81 and 82.

Figure 17:
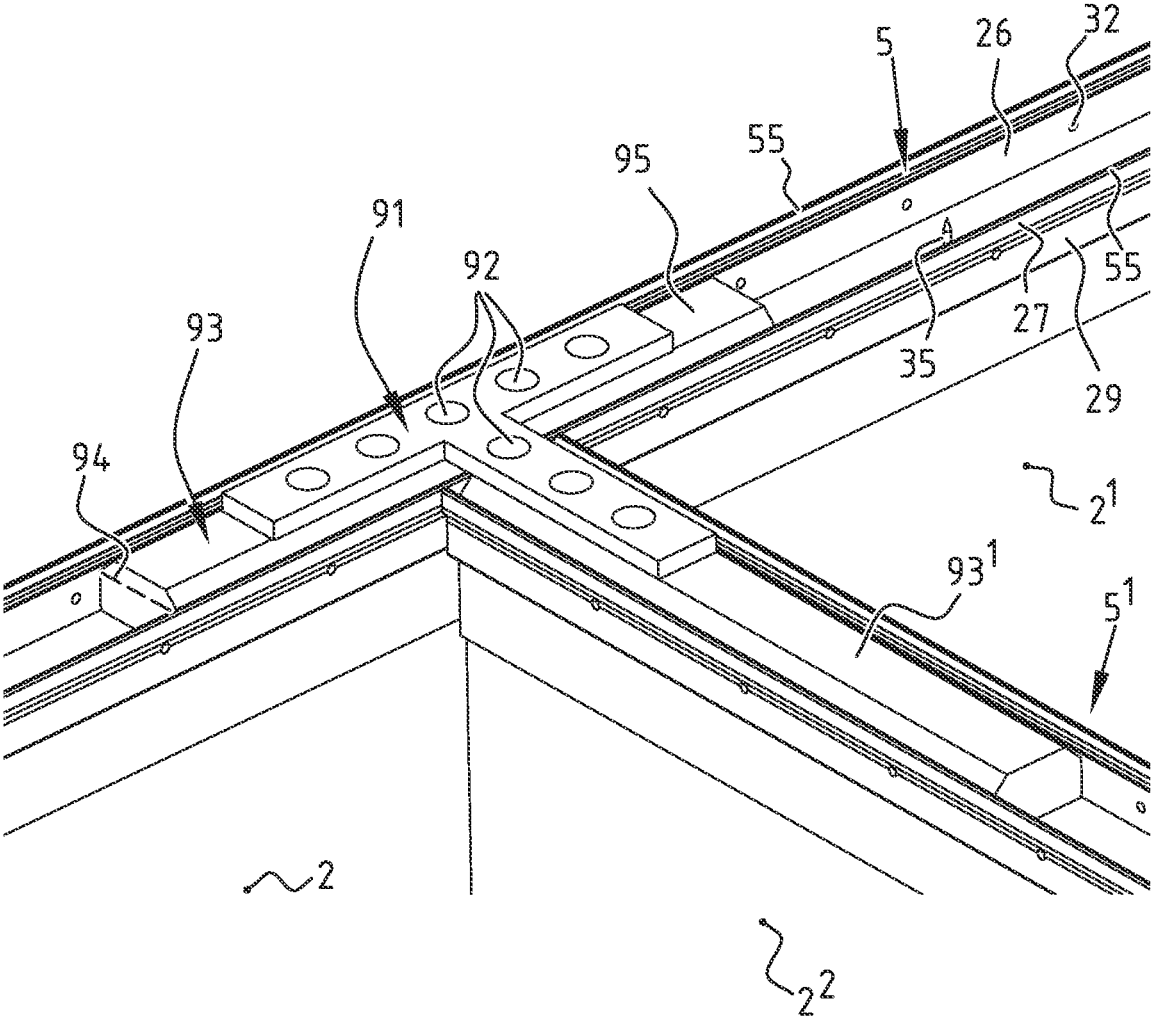
FIG. 17 is a perspective top view of a transverse connection of a wall part to a wall.
Figure 18:
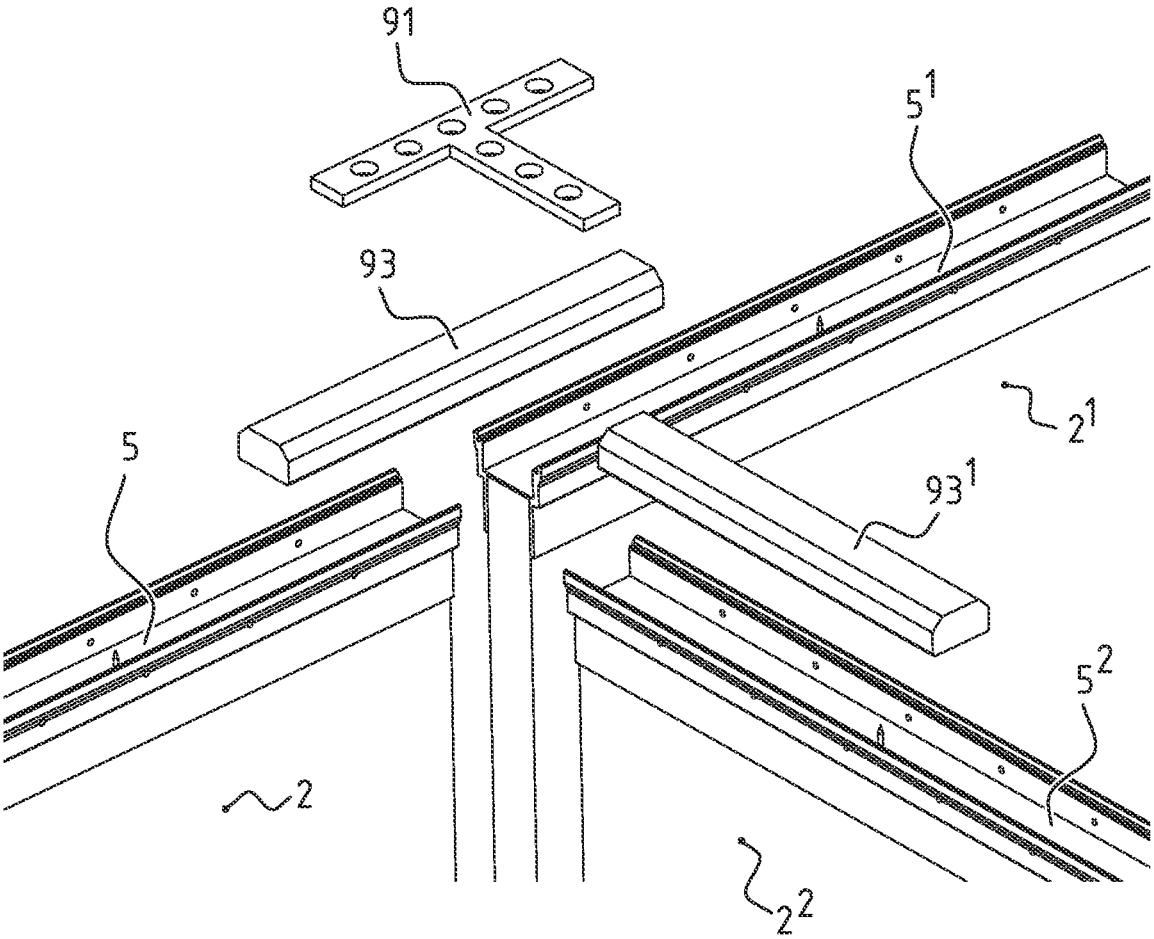
FIG. 18 is an exploded view of a part of the wall of FIG. 17.

FIGS. 17 and 18 show an embodiment of a coupling piece 91 whereby a wall part can be mounted transversely of a flat wall in simple manner. The coupling piece 91 is substantially T-shaped and is provided with a number of openings 92 for receiving therein fastening means 96 such as fastening pins, nails, screws and the like. Instead of the above stated coupling elements 7 or 74, coupling elements 93 are provided in the embodiment. The form and dimensions (and composition) of these coupling elements 93 are exactly the same as the above stated coupling elements, albeit that the coupling elements 93 are raised to some extent on their upper side. In FIG. 17 this is shown by demarcating the raised part 94 of coupling element 93 relative to the form of the above stated coupling elements 7, 74 with a broken line. This raised part 94 provides for a fastening surface 95 which extends to a position above the upper edge 55 of mounting profiles 5 and thus provides an option to fasten the coupling piece 91 via the fastening means (not shown) to the relevant coupling element 93.

As shown in FIG. 17, coupling element 93 is used to mutually couple the two wall parts 2 and $\mathbf{2}^1$ lying mutually in line using profile elements 5 and $\mathbf{5}^1$. Arranged in the profile element $\mathbf{5}^2$ of the wall part $\mathbf{2}^2$ positioned at right angles to the wall parts 2 and $\mathbf{2}^1$ is a similar or identical coupling element $\mathbf{93}^1$. This coupling element $\mathbf{93}^1$ can be coupled via coupling piece 91 to coupling element 93.

The relevant modular wall system is particularly suitable for realizing temporary walls, for instance walls of stands and other temporary provisions. The wall parts can be easily coupled to each other and released from each other, and can be reused readily since essentially no operations whatsoever need be carried out on the wall parts in order to assemble or dismantle them. If the wall system must be removed, the relevant cloth 8 is released from the attaching elements 10, 11 by stretching the cloth either on the lower side or on the upper side and removing it from the relevant teeth of the attaching element. Once the cloth has been removed from a determined attaching element, the tension in the cloth can be reduced to zero so that the cloth can also be easily released from the attaching element on the opposite outer ends. When attaching and releasing the cloth no damage whatsoever is done to the wall part, making them essentially fully reusable.

The invention is not limited to the embodiments thereof described here and is defined by the following claims, within the scope of which numerous modifications can be envisaged.

The invention claimed is:

1. A modular wall system comprising a number of mutually releasably couplable wall modules for forming in coupled state a reusable assembled wall, wherein a wall module comprises:

a first mounting profile arranged on a first outer end of a wall part of the wall module, wherein the first mounting profile comprises a receiving space for receiving therein a first coupling element whereby wall parts of adjacent wall modules can be coupled to each other;

a second mounting profile arranged on a second outer end of the wall part of the wall module lying opposite the first outer end, wherein the second mounting profile comprises a receiving space for receiving therein a second coupling element whereby wall parts of adjacent wall modules can be coupled to each other;

a first cloth attaching element mounted on the first mounting profile, and a second cloth attaching element mounted on the second mounting profile; and an exchangeable cloth to be arranged in front of at least one side of the wall part and to be attached releasably to at least one of the first cloth attaching element and the second cloth attaching element for providing a desired appearance on the at least one side of the wall part, wherein at least one of the first and second cloth attaching element is configured to hook the cloth thereon, wherein at least one of the first and second cloth attaching element comprises a row of pointed teeth configured for pinning the cloth therewith by piercing wholly through the cloth, and wherein at least one of the first mounting profile with the first cloth attaching element and the second mounting profile with the second cloth attaching element is configured to tension the exchangeable cloth at a distance from the at least one side of the wall part.

2. The modular wall system according to claim 1, wherein at least one of the first mounting profile with the first cloth attaching element and the second mounting profile with the second cloth attaching element is configured to keep the exchangeable cloth tensioned without contact between an inner side of the exchangeable cloth and the at least one side of the wall part between the first and second cloth attaching element.

3. The modular wall system according to claim 1, wherein at least one of the first and second cloth attaching element is configured to tension the cloth tautly at a distance in front of the at least one side of the wall part, such that the cloth conceals the at least one side of the wall part from view without touching the side of the wall part.

4. The modular wall system according to claim 1, wherein the distance amounts to at least 0.5 cm.

5. The modular wall system according to claim 1, wherein the row of pointed extend obliquely inward relative to the at least one side of the wall part, and wherein in cross-section through the wall part an angle between the row of pointed teeth and the at least one side of the wall part has a value of between 30 and 60 degrees.

6. The modular wall system according to claim 1, wherein the first and second mounting profile protrude relative to the said at least one side of the wall part, and/or wherein a width of the first and second mounting profile is greater than a thickness of the wall part.

7. The modular wall system according to claim 1, wherein the first coupling element has a flat underside in order to enable the first coupling element and the wall part arranged thereon to be positioned on a flat ground surface in stable manner, and/or wherein the first and second coupling elements are beams.

8. The modular wall system according to claim 1, wherein the receiving space for receiving therein the first coupling element and the receiving space for receiving therein the second coupling element have an elongated form and receiving spaces of adjacent wall modules extend mutually in line during use, and/or wherein the coupling elements comprise elongated coupling elements such as coupling slats and/or coupling beams.

9. The modular wall system according to claim 1, wherein at least one of the first and second cloth attaching elements of the wall part is spring-mounted on the wall part for tensioning the cloth between the first and second cloth attaching elements under spring tension.

10. The modular wall system according to claim 1, wherein the cloth is a fabric being elastic in a first direction and being inelastic in a second direction, perpendicularly of the first direction.

11. The modular wall system according to claim 1, wherein the first mounting profile comprises one or more fixing pins for fastening a coupling element to the first mounting profile.

12. The modular wall system according to claim 1, further comprising:

a flexible skirting strip configured to be mounted on at least one lower coupling element and extending in a mounted state over substantially a whole width of at least one wall part, wherein the flexible skirting strip comprises a strip of fabric, and/or wherein the flexible skirting strip is embodied so that the flexible skirting strip can be unrolled from a roll.

13. The modular wall system according to claim 1, wherein provided in side surfaces of adjacent wall parts are one or more drilled holes which connect to each other in use, and wherein the wall system further comprises an aligning element which is configured to be arranged simultaneously both in a first drilled hole in a side surface of a first wall part and in a second drilled hole positioned opposite the first drilled hole.

14. The modular wall system of claim 1, wherein the second cloth attaching element is arranged in a slot of the second mounting profile.

15. A method for erecting a modular wall system according to claim 1, the method comprising:

placing wall parts of a number of wall modules on a ground surface;

mutually coupling the wall parts using at least one first mounting profile arranged on a first outer end of at least one wall part of at least one wall module and at least one second mounting profile arranged on a second outer end of at least one wall part of at least one wall module lying opposite the first outer end, wherein the first mounting profile and the second mounting profile comprise a receiving space for receiving therein a respective coupling element whereby wall parts of adjacent wall modules can be coupled to each other; and attaching a first part of a cloth with one of a first cloth attaching element mounted on the first mounting profile or a second cloth attaching element mounted on the second mounting profile, wherein the attaching comprises hooking the cloth on a row of pointed teeth of at least one of the first and second cloth attaching elements, for pinning the cloth therewith.

16. The method according to claim 15, further comprising:

first attaching the first part of the cloth to the first cloth attaching element and then attaching a second part of the cloth to the second cloth attaching element and/or attaching a part of the cloth to the first coupling element, and then attaching a second part of the cloth to the first cloth attaching element or the second cloth attaching element.

17. The method according to claim 15, further comprising:

stretching the cloth and attaching the cloth in a stretched state to the second attaching element after the cloth has been attached to the first cloth attaching element or to the first coupling element.

18. The method according to claim 15, further comprising:

placing the first coupling element on the ground surface;

placing one or more wall parts on the first coupling element;

placing a second coupling element on the one or more wall parts; and/or further comprising:

mutually attaching adjacent wall parts by placing the first coupling element in the first mounting profiles of the adjacent wall parts and placing a second coupling element in the second mounting profiles of the adjacent wall parts, wherein a mounting profile in each case extends in at least both a mounting profile of a first wall part and in a mounting profile of a second, adjacent wall part.

19. The method according to claim 15, wherein placing a wall part on the first coupling element comprises sliding the first mounting profile, mounted or formed on an underside of the wall part, over the first coupling element; and/or wherein placing a second coupling element on a wall part comprises sliding the second coupling element into the second mounting profile mounted or formed on an upper side of the wall part.

20. The method according to claim 15, wherein the attaching further comprises:

hooking the cloth to the second cloth attaching element;

pulling the cloth along at least one wall part of at least one wall module in a height direction; and hooking the cloth pulled along the at least one wall part to the first cloth attaching element.

* * * * *